US006567644B1

(12) United States Patent
Yasui

(10) Patent No.: US 6,567,644 B1
(45) **Date of Patent: *May 20, 2003**

(54) IMAGE FORMING APPARATUS

(75) Inventor: Kazumasa Yasui, Tokyo (JP)

(73) Assignee: Toshiba Tec Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/541,670

(22) Filed: Mar. 31, 2000

(51) Int. Cl.[7] ..... G03G 15/00
(52) U.S. Cl. ..... 399/401; 271/3.08; 399/402
(58) Field of Search ..... 271/3.02, 3.03, 271/3.05, 3.08; 399/401, 402

(56) References Cited

U.S. PATENT DOCUMENTS 5,327,206 A * 7/1994 Ueda et al. ..... 399/401

FOREIGN PATENT DOCUMENTS

JP 64-87466 3/1989

* cited by examiner

*Primary Examiner*—Hoang Ngo
(74) *Attorney, Agent, or Firm*—Foley & Lardner

(57) ABSTRACT

An automatic both-side feed unit incorporated in a copy machine automatically reverses paper sheets, each having its one side printed with an image by the printing section, and re-feeds them to the printing section. The automatic both-side feed unit has a stacker for containing, in a stacked manner, paper sheets, each having passed through the printing section and hence having its one side printed with an image, stacking rollers for introducing paper sheets into the stacker, a stacking gate for pressing, in a stacking direction, the paper sheets stacked in the stacker, a pickup roller for sequentially picking up the paper sheets, stacked in the stacker, in a reverse direction, beginning from the lowest one, and a paper re-feed conveyance path for re-feeding each paper sheet picked up by the pickup roller, to the printing section. Further, the stacker contains a pair of openable/closable side guides driven to repeatedly open and close to align both side edges of the paper sheets stacked in the stacker. The side guides are operated when each paper sheet is in a released state assumed after the rear end of the sheet passes through the stacking rollers and before the sheet is stacked by the stacking gate, thereby aligning paper sheets introduced into the stacker. After being aligned by the side guides, each paper sheet is stacked by the stacking gate and picked up by the pickup roller to the paper re-feed conveyance path.

22 Claims, 6 Drawing Sheets

IMAGE FORMING APPARATUS

BACKGROUND OF THE INVENTION

This invention relates to an image forming apparatus equipped with an automatic both-side feed unit which can stack a plurality of paper sheets into a stacker, pick up the stacked sheets one by one in a reverse direction, and re-feed them with their surfaces reversed.

An automatic both-side feed unit incorporated in a digital copy machine is well known as a unit for automatically and continuously reversing a plurality of sheets of materials.

This both-side feed unit includes a stacker for temporarily containing sheets of, for example, paper, which each have one side passed through the image forming section of the machine and hence already provided with an image; a pair of side guides driven to repeatedly open and close to align both side edges of the paper sheets stacked in the stacker; a pickup roller for sequentially picking up the paper sheets, stacked in the stacker, beginning from the lowest one, in a reverse direction; and a paper re-feed conveyance path for sequentially re-feeding, to the image forming section, each paper sheet picked from the stacker by the pickup roller.

When forming images on both sides of each of a plurality of paper sheets by a copy machine with an automatic both-side feed unit as described above, at first, an image is formed on one side of each of all the paper sheets, using the image forming section, and then the paper sheets are sequentially stacked in the stacker. While stacking them, the side guides are driven each time five paper sheets are stacked in the stacker, so as to align the sides of the sheets. After all the paper sheets are stacked in the stacker, the side guides are closed and the pickup roller is rotated, thereby sequentially re-feeding the paper sheets to the image forming section, beginning from the lowest one. The image forming section sequentially forms a predetermined image onto the reverse surface of each re-fed paper sheet.

In order to enhance the productivity of the above-mentioned automatic both-side feed unit, forwarding control is executed in which the front end or ends of one or two paper sheets first stacked in the stacker are forwarded to the paper re-feed conveyance path located upstream of the image forming section. In this forwarding control, the pickup roller is rotated after one or two paper sheets are stacked into the stacker, thereby sequentially picking them up and feeding them to the paper re-feed conveyance path located upstream of the image forming section. This operation enables quick feeding of the front-end-forwarded one or two paper sheets to the image forming section when starting re-feeding of paper sheets which each have one side already provided with an image. As a result, the productivity of the automatic both-side feed unit can be enhanced.

Since, in this forwarding control, one or two paper sheets are once stacked in the stacker and then guided to the paper re-feed conveyance path, the forwarded position of the sheets on the re-feed conveyance path can be fixed. In other words, even when the one or two paper sheets are stacked at different speeds or at irregular points in time, the pickup pitch of the one or two paper sheets, and accordingly their forwarded position on the paper re-feed conveyance path, can be stabilized since the sheets are once stacked in the stacker and then picked up. The fixing of the forwarded position enables stabilization of the re-feeding operation of the first one or two paper sheets, and hence the productivity of the automatic both-side feed unit can be enhanced.

However, where the forwarding control, in which the front end or ends of first one or two paper sheets are forwarded to the paper re-feed conveyance path, is executed together with the control in which the side guides are driven each time five paper sheets are stacked in the stacker, the first one or two paper sheets are not aligned by the side guides when they are introduced into the stacker. Accordingly, the front end or ends of the first one or two paper sheets are forwarded to the paper re-feed conveyance path with unstable conveyance orientations.

More specifically, when a first paper sheet is guided into the stacker and then a second paper sheet is guided into the stacker and stacked on the first one, it is possible that the front end of the second sheet will hit the first sheet, thereby making the first sheet off-centered. Further, when a first sheet is picked up in a state in which a second sheet is stacked on the first sheet, and fed to the paper re-feed conveyance path, it is possible that the second sheet will be badly displaced. Thus, in the above-described conventional control, a paper sheet, which is forwarded to the paper re-feed conveyance path by forwarding control, will easily be displaced badly.

To prevent such a bad displacement of a first or second paper sheet picked up during forwarding control, it is considered to drive the side guides to align the first and/or second paper sheet picked up during forwarding control. However, if the side guides are driven to align the first and/or second sheet, it is possible that third to fifth paper sheets will be guided into the stacker when the side guides are closed, and hence that the third to fifth paper sheets will be brought into contact with the side guides and become jammed.

BRIEF SUMMARY OF THE INVENTION

This invention has been developed in light of the above, and aims to provide an automatic both-side feed unit, which can reliably prevent a reversed paper sheet from becoming badly displaced, can execute forwarding control of stacked paper sheets, and hence has a high productivity, and also to provide an image forming apparatus equipped with the automatic both-side feed unit.

To attain the aim, there is provided an automatic both-side feed unit comprising: a containing section for containing, in a stacked manner, a plurality of sheets of materials sequentially introduced therein in a first direction; pressing means to be operated whenever each of the sheets is introduced into the containing section, to thereby press each sheet in a stacking direction; pickup means for picking up each sheet, introduced into the containing section, in a second direction opposite to the first direction; and aligning means to be operated when each sheet is in a released state assumed after each sheet is introduced into the containing section and before each sheet is pressed by the pressing means, the aligning means aligning each sheet together with other sheets already stacked in the containing section.

Further, an image forming apparatus according to the invention comprises: an image forming section for forming an image on one side of each of paper sheets; a containing section for containing, in a sequentially stacked manner, the paper sheets each having one side thereof provided with an image by the image forming section; introducing means provided near an inlet of the containing section for introducing the paper sheets each having the one side provided with the image which is formed by the image forming section, into the containing section in a first direction; pressing means to be operated whenever each of the paper sheets is introduced into the containing section, to thereby press each paper sheet in a stacking direction; pickup means for picking up each paper sheet, introduced into the containing section, in a second direction opposite to the first direction; paper re-feeding means for re-feeding each paper sheet picked up by the pickup means, to the image forming section; and aligning means to be operated when each paper sheet is in a released state assumed after each paper sheet is introduced by the introducing means into the containing section and before each paper sheet is pressed by the pressing means, the aligning means aligning each paper sheet together with other paper sheets already stacked in the containing section.

DETAILED DESCRIPTION OF THE INVENTION

The embodiment of the invention will be described in detail with reference to the accompanying drawings.

Figure 1:
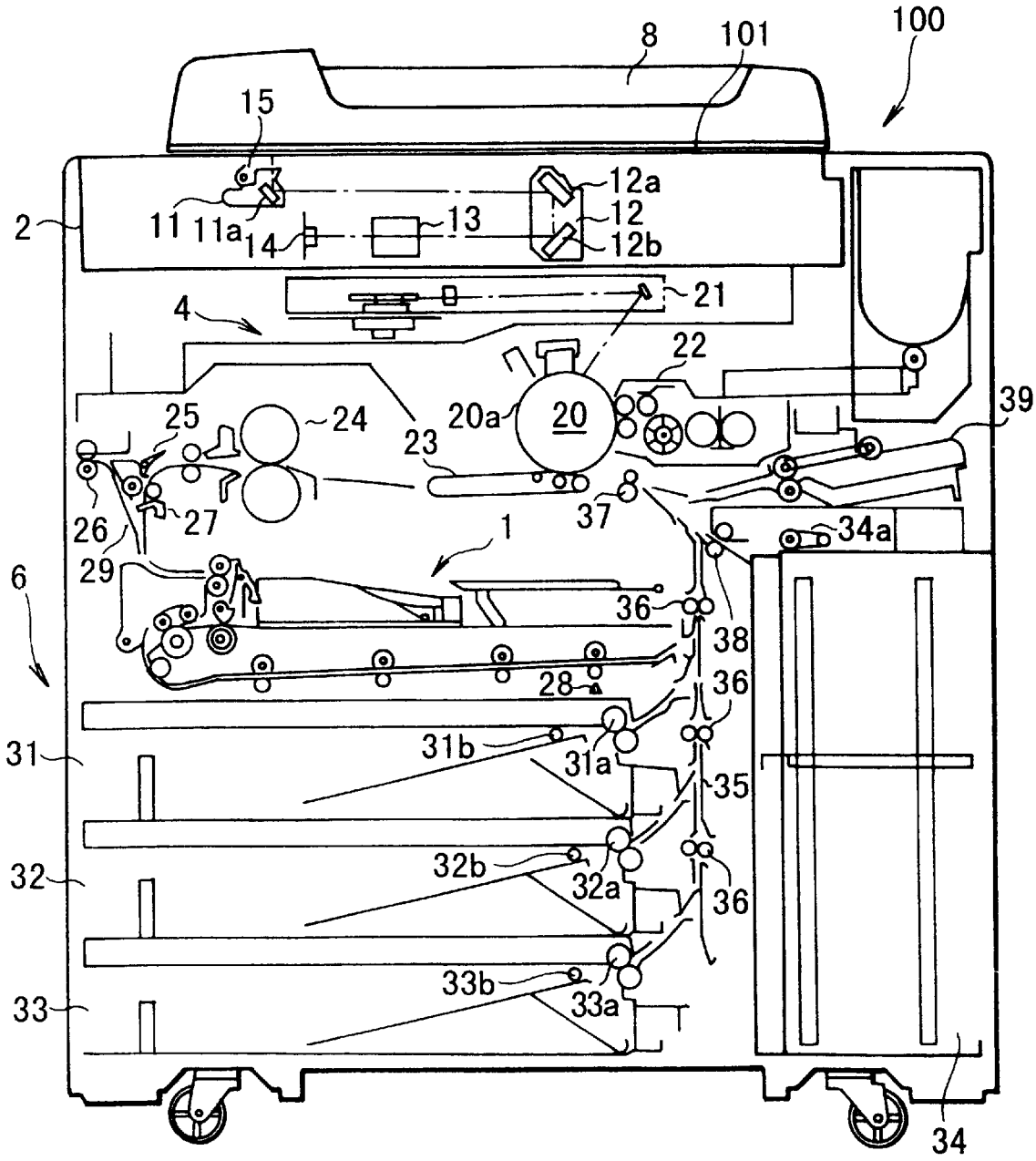
FIG. 1 is a schematic view illustrating a copy machine equipped with an automatic both-side feed unit according to the embodiment of the invention.

FIG. 1 is a schematic view illustrating a digital copy machine 100 (hereinafter simply referred to as a "copy machine 100") equipped with an automatic both-side feed unit 1 according to the embodiment of the invention. The automatic both-side feed unit 1 sequentially receives paper sheets which each have one side printed with an image by a printing section 4 (image forming section) incorporated in the copy machine 100 and described later. The unit 1 then automatically reverses each paper sheet and re-feeds them to the printing section 4.

As is shown in FIG. 1, the copy machine 100 includes a scanner section 2 for reading an image of a document and creating image data; the printing section 4 for outputting an image based on the image data created by the scanner section 2; the automatic both-side feed unit 1 for sequentially reversing paper sheets having their respective one sides already printed with images by the printing section 4, and then re-feeding them to the printing section 4; and a paper supply section 6 for supplying paper sheets of a desired size to the printing section 4. Further, an automatic document feeder (ADF) 8, which serves as a cover for holding a document set on a document table 101 and is disposed to sequentially and automatically feed a plurality of documents onto the document table 101, constitutes an openable/closable upper section of the copy machine 100.

The scanner section 2 includes a first carriage 11 located below the document table 101 so that it can move parallel to the document table 101; a second carriage 12 movable in accordance with the movement of the first carriage 11; a lens 13 for imparting a predetermined image-forming characteristic to light (imaging light) reflected from a document and transmitted through the first and second carriages 11 and 12; and a photoelectric element (CCD sensor) 14 for subjecting, to photoelectric conversion, the imaging light supplied with the predetermined image-forming characteristic through the lens 13.

A document mounted on the document table 101 is illuminated by a light source 15 provided integral with the first carriage 11. Imaging light reflected from the document is further reflected by a first mirror 11*a* incorporated in the first carriage 11, and second and third mirrors 12*a* and 12*b* incorporated in the second carriage 12 in the order mentioned, and is converged onto the CCD sensor 14 through the lens 13. At this time, the first and second carriages 11 and 12 are moved at a predetermined rate along the document table 101. As a result, imaging light that covers the entire surface of the document is received by the CCD sensor 14, whereby image data concerning the entire image of the document is acquired.

The printing section 4 comprises an exposure unit 21 for emitting a laser beam corresponding to the image data obtained from the CCD sensor 14; a photosensitive drum 20 having an outer peripheral surface 20*a* charged with a predetermined potential, and to be scanned by the laser beam emitted from the exposure unit 21 to thereby form a latent image thereon; a developing unit 22 for supplying toner to the latent image formed on the outer peripheral surface 20*a* of the photosensitive drum 20, to develop it; a transfer belt 23 for transferring the developed toner image onto a paper sheet that is supplied at a predetermined point in time from the paper supply section 6 described later; a fixing unit 24 for fixing the toner image transferred on the paper sheet; etc.

The latent image, formed on the outer peripheral surface 20*a* of the photosensitive drum 20 by the scanning operation (for exposure) of the exposure unit 21, is made visible by toner supplied from the developing unit 22. The visualized toner image on the outer peripheral surface 20*a* moves in accordance with the rotation of the drum 20 and transfers onto a paper sheet fed from the paper supply section 6 described later. The sheet with the toner image is guided to the fixing unit 24, where the toner image is heated, melted and fixed on the sheet. The sheet, one side of which is provided with an image formed of the fixed toner, is discharged to the outside of the copy machine through a discharge roller 26 or is guided to the automatic both-side feed unit 1 through a reverse conveyance path 29 (which will be described later), by switching a distributing gate 25 provided downstream of the fixing unit 24.

The paper supply unit 6 has a plurality of cassettes 31, 32 and 33 that can contain sheets of different sizes. The unit 6 also has a large capacity feeder 34 which can contain about 4000 sheets, at maximum, of a relatively frequently used size, for example, A4 size.

Pickup rollers 31*b*, 32*b* and 33*b* are provided near the feeding-side edges (right edges in FIG. 1) of the paper supply cassettes 31, 32 and 33, respectively, for picking up paper sheets one by one from the cassettes, beginning from the uppermost one. Furthermore, paper feed rollers 31*a*, 32*a* and 33*a* are provided adjacent to and downstream of the pickup rollers 31*b*, 32*b* and 33*b*, respectively, in a direction in which paper sheets are taken out of the cassettes. Paper sheets, selectively taken out of the paper supply cassette 31, 32 or 33 by the pickup roller 31*b*, 32*b* or 33*b* and the paper feed roller 31*a*, 32*a* or 33*a*, are conveyed upward through pairs of conveyance rollers 36 provided along a paper feed conveyance path 35, and are guided to a pair of aligning rollers 37 located upstream of the photosensitive drum 20 of the printing section 4.

A pickup roller 34*a* is provided near the upper end of the large capacity feeder 34 for picking up paper sheets, contained in the feeder 34, one by one in order, beginning from the uppermost one. Each paper sheet picked up by the pickup roller 34*a* from the large capacity feeder 34 is guided to the pair of aligning rollers 37 through conveyance rollers 38. A manual paper feed unit 39 is provided above the large capacity feeder 34 for manually feeding paper sheets, and paper sheets fed through the manual paper feed unit 39 are guided to the aligning rollers 37.

Each paper sheet, guided to the aligning rollers 37 from the sheet cassette 31, 32 or 33, the large capacity feeder 34, or the manual paper feed unit 39, which are incorporated in the paper supply section 6, has its front end once aligned by the aligning rollers 37. Then, it is guided to a transfer region situated between the transfer belt 23 and the photosensitive drum 20 in accordance with the rotation of the aligning rollers 37, which is synchronous with the image forming operation of the printing section 4. A predetermined image as aforementioned is transferred onto each paper sheet situated in the transfer region.

Figure 2:
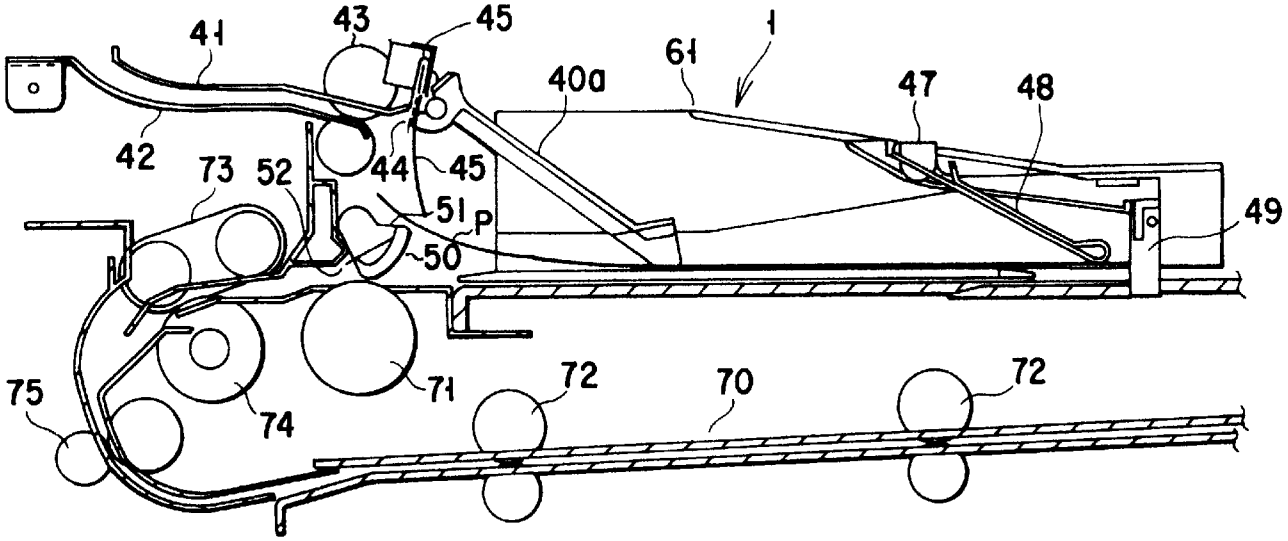
FIGS. 2 and 3 are views useful in explaining the paper reversing operation of the automatic both-side feed unit incorporated in the copy machine of FIG. 1.
Figure 3:
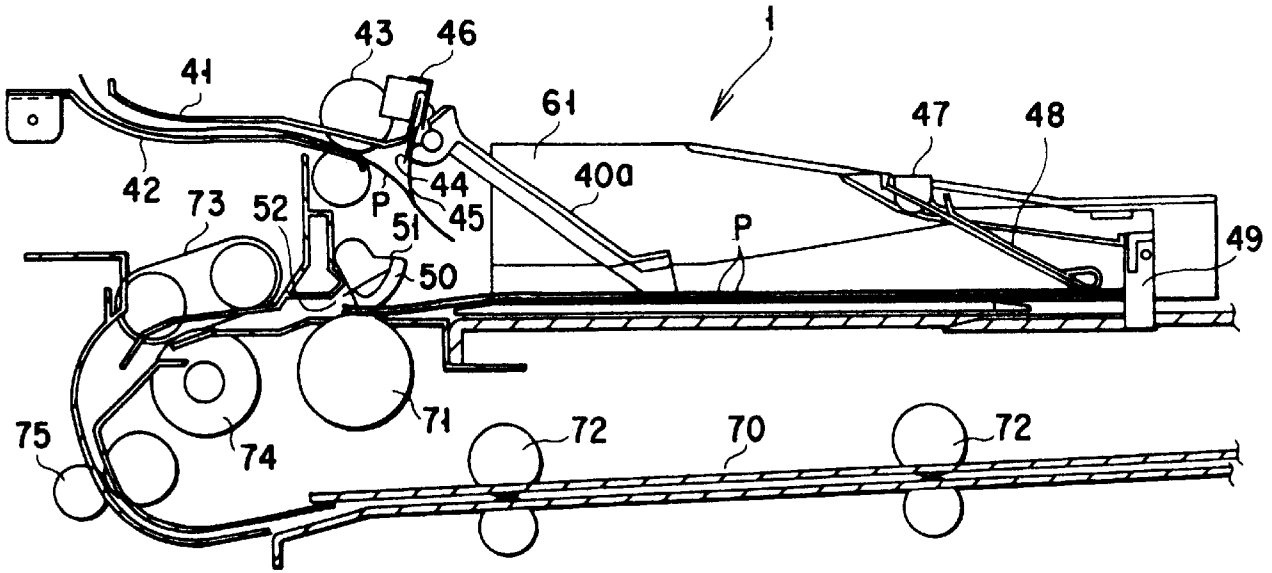
Figure 4:
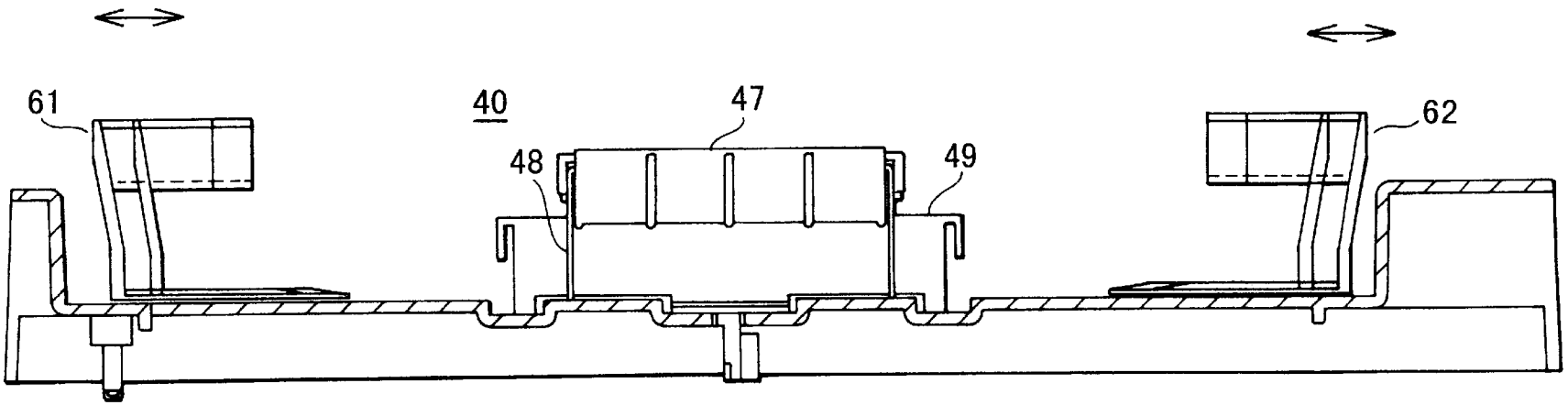
FIG. 4 shows the interior of a stacker included in the automatic both-side feed unit, which is viewed in a paper-forwarding direction.

Referring then to FIGS. 2–4, the automatic both-side feed unit 1 will be described in detail. FIGS. 2 and 3 are views useful in explaining the paper reversing operation of the automatic both-side feed unit 1. FIG. 4 shows the interior of a stacker 40 (container) included in the automatic both-side feed unit 1, which is viewed in a direction in which paper sheets P are forwarded.

The automatic both-side feed unit 1 has a pair of guide members 41 and 42 for guiding, to the stacker 40, each paper sheet P fed from the printing section 4 via the distributing gate 25 and the reverse conveyance path 29 (FIG. 1), i.e. each paper sheet P which has its one side already printed with an image and is to be reversed. Each paper sheet, guided to the left in the figure through the printing section 4, is passed through the reverse conveyance path 29 via the distributing gate 25, moved downward, guided by the guide members 41 and 42 to the right in the figure, and introduced into the stacker 40. During this process, each paper sheet P is reversed. In other words, each paper sheet P to be introduced into the stacker 40 is turned through 180°, and then supplied to the stacker 40 with the side with an image directed downward.

Near those end portions of the guide members 41 and 42 which extend in the stacker 40, i.e. near the inlet of the stacker 40, a pair of stacking rollers 43 (introducing means) are provided for introducing each paper sheet P, guided along the guide members 41 and 42, into the stacker 40 in accordance with their rotation executed with the front end of each paper sheet P held therebetween. A holder 46 with a deelectrifying brush 44 and a conductive Mylar 45 fixed thereto is provided near the stacking rollers 43 downstream of the nip of the stacking rollers 43 in a paper-forwarding direction.

When a paper sheet P guided along the guide members 41 and 42 is introduced into the stacker 40 while it is held between the stacking rollers 43, the front end of the paper sheet P passes the deelectrifying brush 44 and hits the conductive Mylar 45, whereby it is pushed downward (see FIG. 3). After that, the downwardly pushed front end of the paper sheet P is shifted to the right in the figure along the bottom surface of the stacker 40, is further pushed to the right while it is kept in contact with guides 47 and 48, and hits an end guide 49 located at the right end (in the figure) of the stacker 40.

In this embodiment, the Mylar 45 for guiding each paper sheet P into the stacker 40, while keeping in contact with its front end, is formed of a conductive material. Therefore, static electricity, which will occur when the Mylar and the each sheet contact each other, can leak through the Mylar. This prevents attachment of each paper sheet P to the Mylar 45 due to static electricity. As a result, unstable stacking of paper sheets P can be prevented, which may occur when, for example, a paper sheet P is off-centered or the rear end of the sheet P is not correctly placed on a paper receiving section 51 of a stacking gate 50.

Each paper sheet P guided into the stacker 40 as described above is received in the stacker 40 in a state as shown in FIG. 2. The position of the end guide 49 is set so that the rear end of each paper sheet P will pass through the nip of the stacking rollers 43 and will be released immediately before its front end is brought into contact with the end guide 49. In other words, the end guide 49 can be moved by a driving mechanism (not shown) in the paper-forwarding direction, and is moved in accordance with the size and the direction of paper sheets P guided into the automatic both-side feed unit 1.

The rear end of each paper sheet P in a released state is placed on the paper receiving section 51 of the stacking gate 50, which is located below the stacking rollers 43. In this state, a rear end portion of the paper sheet P is pressed with the slight force of the front end of the conductive Mylar 45. Moreover, the paper sheets P guided to the stacker 40 are detected by an actuator 40*a* provided in the stacker 40, thereby determining that at least one paper sheet is contained therein.

As is shown in FIG. 4, a pair of side guides 61 and 62 (aligning means) for aligning paper sheets P introduced into the stacker 40 are located along the width direction of the stacker 40 which is perpendicular to the paper-forwarding direction. The side guides 61 and 62 are opened and closed a predetermined number of times (twice in this embodiment) in directions indicated by the arrows immediately after each paper sheet P is released, so that the opposite sides of each paper sheet P are aligned. As a result, the width-directional ends of each paper sheet P are adjusted.

When the side guides 61 and 62 are in their standby state assumed before each paper sheet P is introduced into the stacker 40, they are situated in their open positions in which they are most widened to the outside. In this embodiment, in order to execute the opening/closing operation of the side guides 61 and 62 as quickly as possible, the open position of each of the side guides 61 and 62 is set at a distance of about 1.5 mm to the outside from the closed position of a corresponding one of the side guides 61 and 62. Like the end guide 49, the closed position of each of the side guides 61 and 62 is movable so that it shifts depending upon the size and the direction of paper sheets P introduced into the stacker 40.

When a paper sheet P, which is in a released state as shown in FIG. 2, is adjusted by the opening/closing operation of the side guides 61 and 62, the stacking gate 50 is rotated clockwise by one rotation, whereby the rear end of the paper sheet P placed on the paper receiving section 51 is pressed under the stacking gate 50. More specifically, when the stacking gate 50 is rotated, with the rear end of the paper sheet P placed on the paper receiving section 51 of the stacking gate 50, the front end of the Mylar 45, which projects above the stacking gate 50, catches and drops the rear end of the paper sheet P into a position 52 under the stacking gate 50 as shown in FIG. 3. Thus, stacking of the paper sheet P is completed.

While a pickup roller 71 located below the stacking gate 50 rotates, it picks up the paper sheet P, stacked under the stacking gate 50, this time with the rear end of the sheet placed in front, and sends it to a paper re-feed conveyance path 70 that extends below the stacker 40 substantially parallel thereto. Pairs of conveyance rollers 72 are provided along the paper re-feed conveyance path 70. The downstream end of the paper re-feed conveyance path 70 is connected to the paper feed conveyance path 35, which is connected to the aligning rollers 37.

The paper sheet P, picked out of the stacker 40 by the pickup roller 71, is passed between a separating belt 73 and a paper feed roller 74 located downstream of the pickup roller 71 in a direction in which each paper sheet P is picked up. The sheet P is then adjusted by a pair of resist rollers 75 located downstream of the belt and the paper feed roller, and then sent to the paper re-feed conveyance path 70. Near the conveyance rollers 72 located furthest downstream, a forwarded position switch 28 (see FIG. 1) is provided for detecting arrival of the front end of each paper sheet P guided to the paper re-feed conveyance path 70, and stopping it in a predetermined forwarded position.

Further, a reversing switch 27 (detecting means) for detecting passing of the rear end of each paper sheet P is provided in the reverse conveyance path 29 directed from the distributing gate 25 to the automatic both-side feed unit 1.

Figure 5:
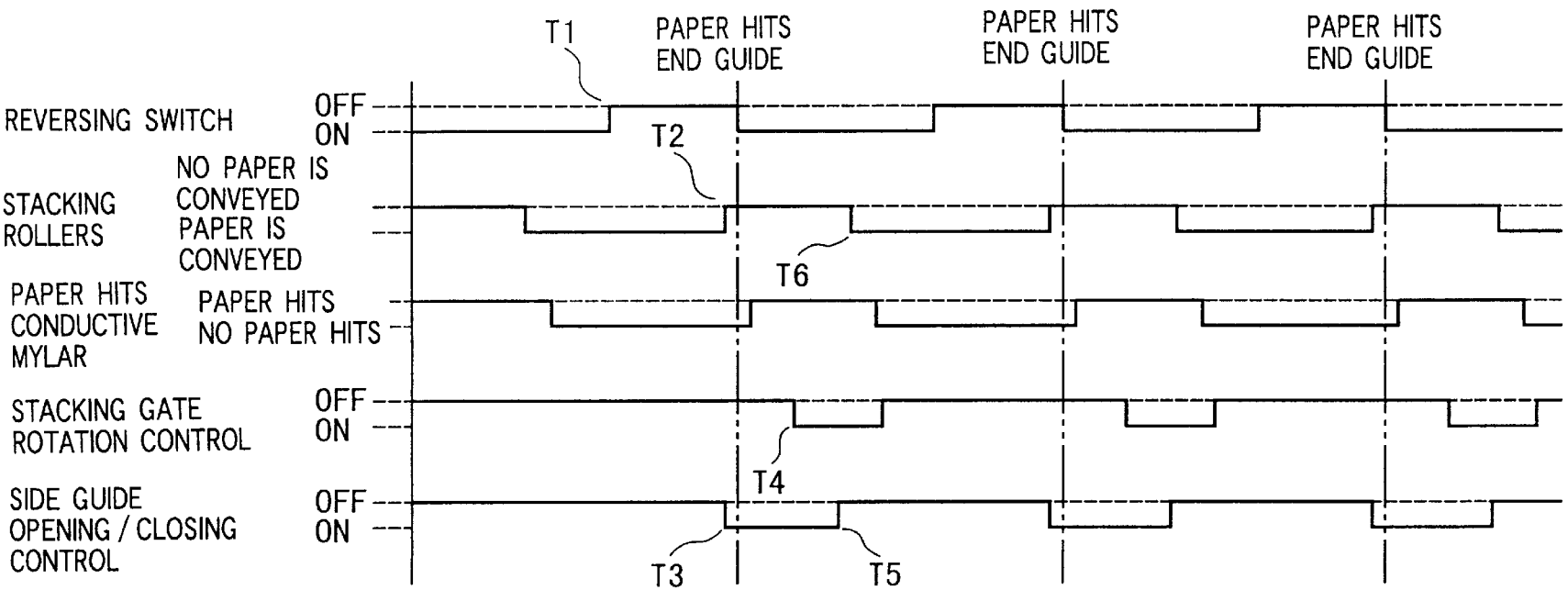
FIG. 5 is a timing chart useful in explaining the operation timing of side guides.

Referring now to the timing chart of FIG. 5 and the flowchart of FIG. 6, the opening/closing timing of the side guides 61 and 62 will be described.

First, the reversing switch 27, provided in the reverse conveyance path 29 directed to the automatic both-side feed unit 1, detects passing of the rear end of a paper sheet P (time point T1). Then, it is determined whether or not a predetermined period in time (about 260 ms in this embodiment) has elapsed after the passing of the rear end of the sheet is detected (step S1). This period of time is set in accordance with the conveyance rate of each paper sheet P, the distance from the reversing switch 27 to the nip of the stacking rollers 43, and the length of each paper sheet P in the conveyance direction. In other words, the period is set at a value required until the rear end of each paper sheet P, which has passed through the reversing switch 27, passes through the nip of the stacking rollers 43 (time point T2).

If it is determined at the step S1 that a predetermined period elapses after the rear end of the paper sheet P passes through the reversing switch 27 (i.e. if the answer at the step S1 is Yes), it is determined that the paper sheet P is in a released state in the stacker 40, thereby starting the opening/closing operation of the side guides 61 and 62 (time point T3; step S2). In this embodiment, the side guides 61 and 62 are opened and closed twice, thereby adjusting the opposite sides of each paper sheet P introduced into the stacker 40. Until the rear end of each paper sheet P passes through the stacking rollers 43 (time point T2), the side guides 61 and 62 are not operated and are each situated in a home position, i.e. the open position.

Immediately before the opening/closing operation of the side guides 61 and 62 is finished (time point T4), more specifically while the second opening/closing operation is executed, the stacking gate 50 is rotated to thereby stack the rear end of the paper sheet P under the stacking gate 50. The finish time point (T5) of the opening/closing operation of the side guides 61 and 62 is set at a time point (T6) at least before the front end of the next paper sheet P reaches the nip of the stacking rollers 43.

Figure 6:
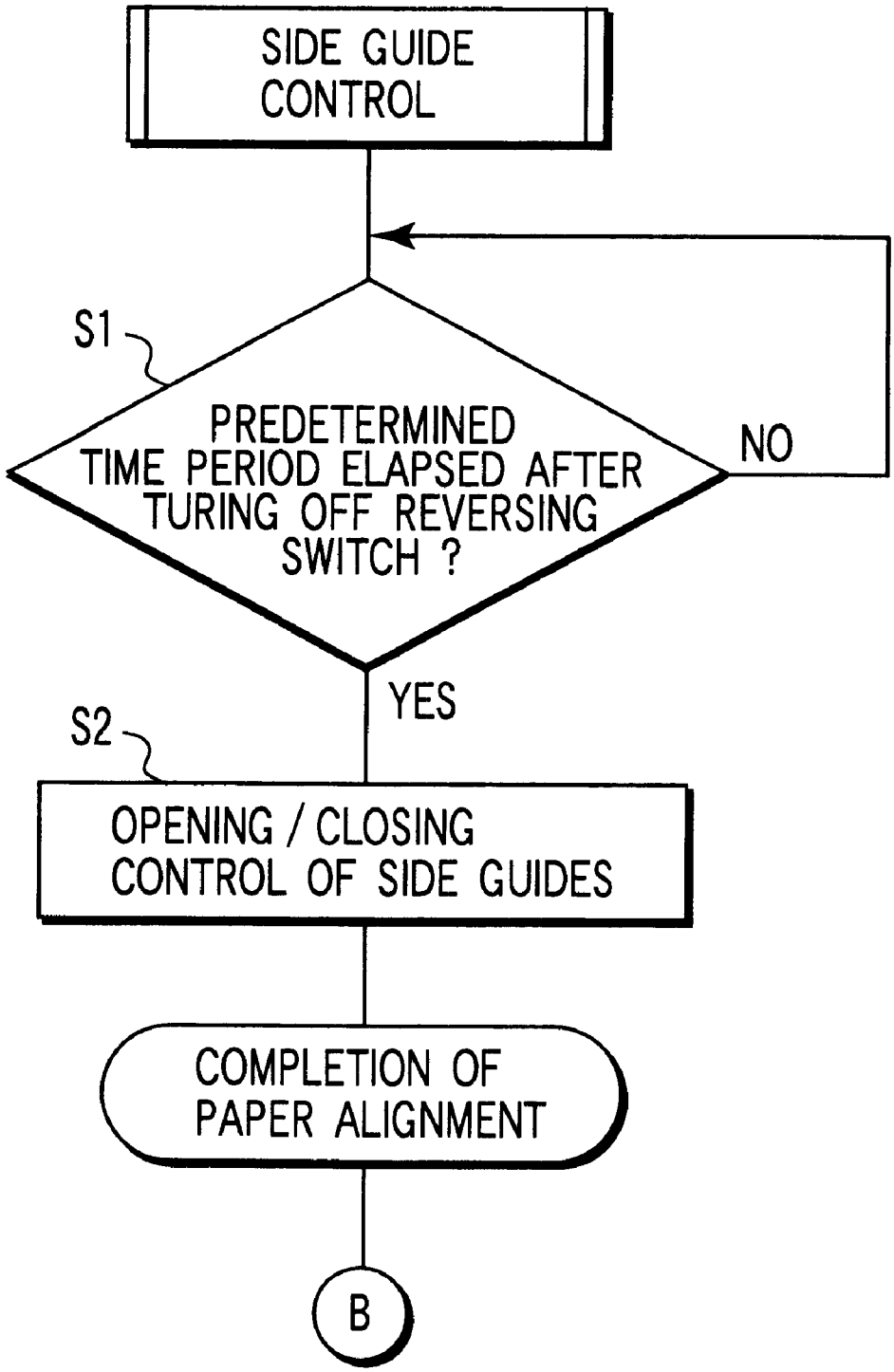
FIG. 6 is a flowchart useful in explaining the operation timing of the side guides.

As described above, the timing control executed in the embodiment is simple control in which the rear end position of each paper sheet P is monitored to operate the side guides 61 and 62, as is shown in FIG. 6. This permits the side guides 61 and 62 to be operated with the same timing for a paper sheet of any size, and hence complicated timing control is not necessary.

Further, in the embodiment, the side guides 61 and 62 are operated to adjust the opposite sides of each paper sheet P, when each paper sheet P is in a released state assumed after it is introduced into the stacker 40 and before it is stacked by the stacking gate 50. With the same timing, all the paper sheets P introduced into the stacker 40 are aligned before being stacked, which means that they can be aligned in a reliable and stable manner. Furthermore, since in the embodiment, the stacking roller 50 starts to rotate substantially in synchronism with the second opening/closing operation of the side guides 61 and 62, off-centering of each paper sheet P due to the rotation of the stacking roller 50 can also be avoided. Accordingly, even when slightly forwarding the front end or ends of first one or two paper sheets P, their conveyance positions can be stabilized, and disadvantages such as skew, jam, etc., which may occur during re-feeding paper sheets, can be prevented. As a result, an image forming operation on the reverse surface of each paper sheet can be stabilized.

In addition, since in the embodiment, the operations of the side guides 61 and 62 are finished before the next paper sheet P is guided into the stacker 40, the side guides 61 and 62 are in their open positions when the next paper sheet P is sent to the stacker 40. Accordingly, the opening/closing operation of the side guides 61 and 62 does not interrupt the introduction of each paper sheet P into the stacker 40, and therefore they are prevented from being brought into contact with each paper sheet P, thereby preventing their jamming or corner-folding.

In other words, although in the embodiment, the number of the opening/closing operations of the side guides 61 and 62 is set at two, it can be desirably set in accordance with the transfer intervals of paper sheets P. It is sufficient to set the number and the timing of the opening/closing operations of the side guides 61 and 62 so that the side guides 61 and 62 will start their opening/closing operations immediately after the rear end of each paper sheet P passes through the nip of the stacking rollers 43 and is released, and will stop the operations before the next paper sheet P is introduced into the stacker 40.

Figure 7:
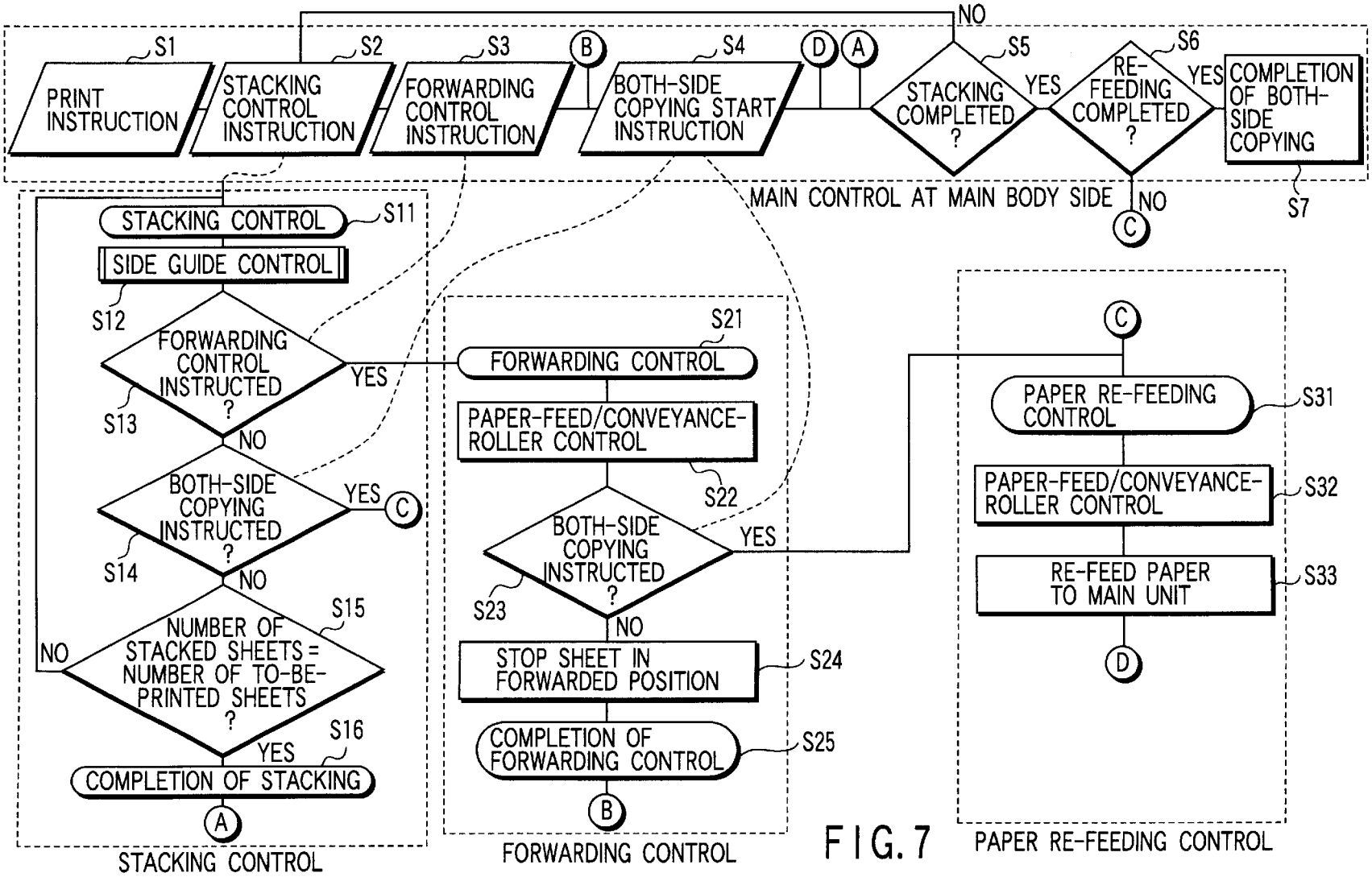
FIG. 7 is a flowchart useful in explaining the both-side copying operation of the copy machine shown in FIG. 1.

Referring then to the flowchart of FIG. 7, the both-side copying operation of the copy machine 100 with the above-described automatic both-side feed unit 1 will be described. The automatic both-side feed unit 1 executes different operations in accordance with the number of paper sheets to be printed. Therefore, a description will be given of two cases—a case where both-side copying is executed on a relatively small number of paper sheets P, specifically, not more than five paper sheets, and a case where it is executed on a relatively large number of paper sheets P, specifically, not less than six paper sheets.

When executing both-side copying on five or less paper sheets P, the copying operation is started on one side of each paper sheet P on the basis of an instruction to execute printing, output during execution of main control at the main unit side of the copy machine (step 1). Paper sheets P each having one side thereof provided with an image are sequentially fed to the automatic both-side feed unit 1 via the distributing gate 25 on the basis of an instruction to execute stacking control, output during execution of the main control at the main unit side (step 2).

Each paper sheet P sent to the automatic both-side feed unit 1 is sent to the stacker 40 by stacking control executed by the automatic both-side feed unit 1 (step 11). Each paper sheet P sent to the stacker 40 is aligned by side-guide control (step 12) described in detail with reference to FIG. 6, and then stacked in accordance with the rotation of the stacking gate 50.

In the case of both-side copying on five or less paper sheets P, an instruction to execute forwarding control (step 3) is output during main control at the main unit side (the answer at a step 13 is Yes), when the first paper sheet P has been stacked. Accordingly, the program proceeds to the forwarding control executed by the automatic both-side feed unit 1 (step 21). In the forwarding control, the pickup roller 71 is rotated to pick up, from the stacker 40, the paper sheet P stacked by the stacking gate 50 (step 22), thereby sending it to the paper re-feed conveyance path 70.

At this time, the program proceeds to paper re-feed control (step 31) on the basis of an instruction to start both-side copying (step 4) output during main control at the main unit side. In the paper re-feed control, the conveyance rollers 72 along the paper re-feed conveyance path 70, the conveyance rollers 36 along the paper feed conveyance path 35, and the aligning roller 37 upstream of the printing section 4 are rotated (step 32), thereby re-feeding, to the printing section 4, the paper sheet P sent to the paper re-feed conveyance path 70 by the forwarding control at the step 21 (step 33).

The paper sheet P is re-fed to the printing section 4 with its two sides reversed by the automatic both-side feed unit 1, and a predetermined image is now formed on the reverse side of the paper sheet P. The paper sheet P having its both sides provided with images is discharged to the outside of the machine through the discharge rollers 26 by switching the distributing gate 25. Then, in the main control at the main unit side, it is determined that stacking is completed (the answer at a step 5 is Yes) and paper re-feeding is completed (the answer at a step 6 is Yes), which is the completion of both-side copying (step 7).

On the other hand, in the case of both-side copying of six or more paper sheets P, at first, first and second paper sheets P each having one side provided with an image are stacked under the stacking gate 50 by the stacking control at the step 11 (FIG. 3). Then, on the basis of the instruction for the forwarding control (step 3) included in the main control at the main unit side, the program proceeds to the forwarding control at the step 21, thereby sending, to the paper re-feed conveyance path 70, the first and second paper sheets P stacked in the stacker 40 (step 22). Since at this time, an instruction to start both-side copying is not yet issued during main control at the main unit side (the answer at a step 23 is No), the first paper sheet P sent to the paper re-feed conveyance path 70 is stopped when it is detected by the forwarded position switch 28 located near the downstream-side end of the paper re-feed conveyance path 70 (step 24). The second paper sheet P is also stopped when the first paper sheet P is stopped. This is the completion of the forwarding control (step 25).

The third et seq. paper sheets P introduced into the stacker 40 subsequent to the first and second paper sheets P are sequentially aligned and stacked under the stacking gate 50 by the stacking control at the step 11 (steps 11–15). After all of the third et seq. paper sheets P to be printed are stacked in the stacker 40 (the answer at a step 15 is Yes), the stacking operation is stopped (step 16).

If the both-side copying start instruction is issued during main control at the main unit side before the completion of the stacking operation (the answer at a step 14 is Yes), the program proceeds to paper re-feed control at a step 31, thereby rotating the conveyance rollers 72, the conveyance rollers 36 and the aligning roller 37 (step 32). As a result, the paper sheets are sequentially re-fed to the printing section 4, beginning from the first and second paper sheets P forwarded on the paper re-feed conveyance path 70 by the forwarding control at the step 21 (step 33).

The paper sheets P re-fed to the printing section 4 have their reverse sides printed with predetermined images, and then are discharged to the outside of the machine via the discharge rollers 26 by switching the distributing gate 25. Then, in the main control at the main unit side, it is determined that stacking is completed (the answer at the step 5 is Yes) and paper re-feeding is completed (the answer at the step 6 is Yes), which is the completion of both-side copying (step 7).

As described above, in the both-side copying operation of the copy machine 100 with the automatic both-side feed unit 1 according to the embodiment, the stacking control for stacking paper sheets P in the stacker 40 of the automatic both-side feed unit 1, the forwarding control for forwarding the front ends of the paper sheets P, stacked in the stacker 4, on the paper re-feed conveyance path 70 located upstream of the printing section 4, and the paper re-feeding control for re-feeding the front-end-forwarded paper sheets P to the printing section 4 are executed independently of each other. This enables, at any time during main control at the main unit side, issuing of an instruction to execute the stacking control, an instruction to execute the forwarding control, and an instruction to start the both-side copying.

The present invention is not limited to the above-described embodiment, but can be modified in various ways without departing from its scope.

What is claimed is:

1. An automatic both-side feed unit comprising:

a containing section for containing, in a stacked manner, a plurality of sheets of materials sequentially introduced therein in a first direction;

a rotatable stacking gate having a receiving section for receiving a rear end portion of each of the sheets which is introduced into the containing section, wherein after the rear end portion is positioned on top of the receiving section, the rear end portion is pressed under the stacking gate when the stacking gate is rotated;

pickup means for picking up each sheet, introduced into the containing section, in a second direction opposite to the first direction; and aligning means to be operated when each sheet is in a released state assumed after each sheet is introduced into the containing section and before each sheet is pressed by the rotatable stacking gate, the aligning means aligning each sheet together with other sheets already stacked in the containing section.

2. The automatic both-side feed unit according to claim 1, wherein the aligning means includes a pair of side guides which are movable in a third direction perpendicular to the first direction and to the stacking direction, and drives the pair of side guides to opposite sides of each of the sheets stacked in the containing section so as to align each sheet.

3. The automatic both-side feed unit according to claim 2, wherein before another sheet is introduced into the containing section, the pair of side guides are situated in their respective open positions in which they do not interrupt introduction of said another sheet.

4. The automatic both-side feed unit according to claim 2, further comprising detecting means for detecting said each sheet introduced into the containing section, and wherein the side guides are driven a predetermined time period after the detecting means detects a rear end of each sheet.

5. The automatic both-side feed unit according to claim 1, wherein the pickup means sequentially picks up the sheets contained in the containing section in the stacked manner, beginning from a lowest one.

6. The automatic both-side feed unit according to claim 1, wherein said stacking gate further includes a member for catching the rear end portion of the sheet and guiding the sheet under the stacking gate as the stacking gate is rotated.

7. An image forming apparatus comprising:

an image forming section for forming an image on one side of each of paper sheets;

a containing section for containing, in a sequentially stacked manner, the paper sheets each having one side thereof provided with an image by the image forming section;

introducing means provided near an inlet of the containing section for introducing the paper sheets each having the one side provided with the image which is formed by the image forming section, into the containing section in a first direction;

a rotatable stacking gate having a receiving section for receiving a rear end portion of each of the sheets which is introduced into the containing section, wherein after the rear end portion is positioned on top of the receiving section, the rear end portion is pressed under the stacking gate when the stacking gate is rotated;

pickup means for picking up each paper sheet, introduced into the containing section, in a second direction opposite to the first direction;

paper re-feeding means for re-deeding each paper sheet picked up by the pickup means, to the image forming section; and aligning means to be operated when each paper sheet is in a released state assumed after each paper sheet is introduced by the introducing means into the containing section and before each paper sheet is pressed by the rotatable stacking gate, the aligning means aligning each paper sheet together with other paper sheets already stacked in the containing section.

8. The image forming apparatus according to claim 7, wherein the aligning means includes a pair of side guides which are movable in a third direction perpendicular to the first direction and to the stacking direction, and drives the pair of side guides to opposite sides of each of the paper sheets stacked in the containing section so as to align each paper sheets.

9. The image forming apparatus according to claim 8, wherein before another paper sheet is introduced into the containing section, the pair of side guides are situated in their respective open positions in which they do not interrupt introduction of said another paper sheet.

10. The image forming apparatus according to claim 8, further comprising detecting means for detecting each paper sheet introduced into the containing section, and wherein the side guides are driven a predetermined time period after the detecting means detects a rear end of each paper sheet.

11. The image forming apparatus according to claim 7, wherein the pickup means sequentially picks up the paper sheets contained in the containing section in the stacked manner, beginning from a lowest one.

12. The image forming apparatus according to claim 7, wherein said stacking gate further includes a member for catching the rear end portion of the sheet and guiding the sheet under the stacking gate as the stacking gate is rotated.

13. An automatic both-side feed unit comprising:

a container to contain a plurality of sheets of material sequentially introduced therein in a first direction;

a plurality of guides, wherein after introduction of each of the sheets of material into the container, the sheets of material are aligned by the guides;

a rotatable stacking gate having a receiving section for receiving a rear end portion of each of the sheets which is introduced into the container, wherein after the rear end portion is positioned on top of the receiving section, the rear end portion is pressed under the stacking gate when the stacking gate is rotated; and a pickup member wherein each of the sheets of material is moved by the pickup member in a second direction opposite to the first direction.

14. The automatic both-side feed unit according to claim 13, wherein the guides include a pair of side guides which are movable in a third direction perpendicular to the first direction and to the stacking direction, and which are driven to opposite sides of each of the sheets of material stacked in the container so as to align each of the sheets of material.

15. The automatic both-side feed unit according to claim 14, wherein after alignment of the sheets of material in the container, the pair of side guides are situated in respective open positions such that introduction of each sheet of material into the container is not interrupted by the pair of side guides.

16. The automatic both-side feed unit according to claim 14, further comprising a switch for detecting the presence of each sheet of material introduced into the container, and wherein the pair of side guides are driven a predetermined time after the switch detects a rear end portion of each sheet of material.

17. The automatic both-side feed unit according to claim 14, wherein the pickup member sequentially moves each of the sheets of material in the container, beginning with a bottommost sheet.

18. The automatic both-side feed unit according to claim 13, wherein said stacking gate further includes a member for catching the rear end portion of the sheet and guiding the sheet under the stacking gate as the stacking gate is rotated.

19. The automatic both-side feed unit according to claim 13, wherein the pickup member comprises a roller.

20. The automatic both-side feed unit according to claim 1, wherein the stacking gate rotates 360° each time one of the sheets is loaded into the containing section.

21. The image farming apparatus according to claim 7, wherein the stacking gate rotates 360° each time one of the sheets is loaded into the containing section.

22. The automatic both-side feed unit according to claim 13, wherein the stacking gates rotates 360° each time one of the sheets is loaded into the container.

* * * * *